US012546569B2

(12) United States Patent
Planck

(10) Patent No.: US 12,546,569 B2
(45) Date of Patent: Feb. 10, 2026

(54) LOW PROFILE RAIL MOUNT FOR FIREARM

(71) Applicant: Crimson Trace Corporation, Columbia, MO (US)

(72) Inventor: William A. Planck, Columbia, MO (US)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 18/742,003

(22) Filed: Jun. 13, 2024

(65) Prior Publication Data

US 2024/0328755 A1 Oct. 3, 2024

Related U.S. Application Data

(62) Division of application No. 17/032,493, filed on Sep. 25, 2020, now Pat. No. 12,038,256.

(60) Provisional application No. 62/905,902, filed on Sep. 25, 2019.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS

| | | | | |
|---|---|---|---|---|
| 2,548,031 | A | 4/1951 | Marcus | |
| 3,045,351 | A | 7/1962 | Dayton | |
| 3,559,940 | A | 2/1971 | Kruzell | |
| 3,579,840 | A | 5/1971 | Heinzel | |
| 3,750,318 | A | 8/1973 | Burris | |
| 3,979,848 | A * | 9/1976 | Ackerman, Jr. | F41G 11/003 42/126 |
| 4,688,345 | A | 8/1987 | Kilgour | |
| 4,697,226 | A | 9/1987 | Verdin | |
| 4,959,908 | A * | 10/1990 | Weyrauch | F41G 11/003 42/127 |
| 5,033,219 | A | 7/1991 | Johnson et al. | |
| 5,048,215 | A * | 9/1991 | Davis | F41C 23/22 42/71.01 |
| 5,179,235 | A | 1/1993 | Toole | |
| 5,194,007 | A | 3/1993 | Marshall et al. | |
| 5,237,773 | A | 8/1993 | Claridge | |
| 5,400,540 | A | 3/1995 | Solinsky et al. | |
| 5,428,915 | A | 7/1995 | King | |
| 5,430,967 | A | 7/1995 | Woodman, III et al. | |
| 5,435,091 | A | 7/1995 | Toole et al. | |
| 5,560,703 | A | 10/1996 | Capps, III | |
| 5,581,898 | A | 12/1996 | Thummel | |
| 5,584,137 | A | 12/1996 | Teetzel | |
| 5,590,486 | A | 1/1997 | Moore | |
| 5,603,594 | A * | 2/1997 | Lincoln | H01R 13/6215 411/84 |
| 5,618,099 | A | 4/1997 | Brubacher | |

(Continued)

*Primary Examiner* — Michelle Clement
(74) *Attorney, Agent, or Firm* — Stinson LLP

(57) ABSTRACT

A low profile rail mounting system, comprises an adaptor for mounting an accessory on a firearm rail. The adaptor can include flexible material such that the adaptor can be snapped into position to mount the adaptor on the firearm rail. The adaptor includes opposite grooves that receive the firearm rail to maintain the adaptor on the rail.

20 Claims, 7 Drawing Sheets

(56) References Cited

U.S. PATENT DOCUMENTS 5,628,555 A 5/1997 Sharrah et al.
5,669,173 A 9/1997 Rodney, Jr.
5,685,105 A 11/1997 Teetzel
5,706,600 A 1/1998 Toole et al.
5,758,448 A 6/1998 Thummel
D398,410 S 9/1998 Fell et al.
5,913,669 A 6/1999 Hansen et al.
5,941,489 A * 8/1999 Fanelli ..... F41G 1/16 42/114
6,023,875 A 2/2000 Fell et al.
6,139,237 A * 10/2000 Nagayama ..... F16B 37/048 411/181
6,185,854 B1 2/2001 Solinsky et al.
6,230,431 B1 5/2001 Bear
6,276,088 B1 8/2001 Matthews et al.
6,363,648 B1 4/2002 Kranich et al.
6,378,237 B1 4/2002 Matthews et al.
6,392,147 B1 5/2002 Hier et al.
6,418,657 B1 * 7/2002 Brown ..... F41G 1/26 42/126
6,438,888 B1 8/2002 Lin et al.
6,513,251 B2 2/2003 Huang et al.
6,526,688 B1 3/2003 Danielson et al.
6,571,503 B2 6/2003 Thorpe
6,574,901 B1 6/2003 Solinsky et al.
6,578,311 B2 6/2003 Danielson et al.
6,598,333 B1 7/2003 Randazzo et al.
6,606,813 B1 * 8/2003 Squire ..... F41G 11/003 42/111
6,609,810 B2 8/2003 Kim
6,671,991 B1 1/2004 Danielson
6,698,127 B2 3/2004 Weber
6,705,038 B2 3/2004 Davenport et al.
6,722,074 B1 4/2004 Farrell
6,725,594 B2 * 4/2004 Hines ..... F41A 35/02 42/124
6,732,987 B2 5/2004 Wooten et al.
6,733,221 B2 * 5/2004 Linger ..... F16B 37/045 411/84
6,782,652 B1 * 8/2004 Erickson ..... F41A 35/02 42/143
6,874,269 B2 4/2005 Chen et al.
D505,177 S 5/2005 Fell et al.
6,931,778 B1 8/2005 Nelson et al.
6,994,449 B2 2/2006 Kim
7,117,624 B2 10/2006 Kim
7,134,234 B1 11/2006 Makarounis
D536,116 S 1/2007 Sharrah
7,188,978 B2 3/2007 Sharrah et al.
7,199,315 B1 4/2007 Sharrah et al.
7,199,351 B2 4/2007 Toma
D543,446 S 5/2007 DiNenna
D548,385 S 8/2007 Sharrah et al.
7,260,910 B2 8/2007 Danielson
7,260,912 B2 8/2007 Liu
7,264,369 B1 9/2007 Howe
7,273,292 B2 9/2007 Kim
7,310,903 B2 12/2007 Kim
7,325,352 B2 2/2008 Matthews et al.
7,332,682 B2 2/2008 Kim
D567,894 S 4/2008 Sterling et al.
7,360,333 B2 4/2008 Kim
D568,508 S 5/2008 Howe et al.
D578,599 S 10/2008 Cheng
7,438,430 B2 10/2008 Kim
7,441,918 B2 10/2008 Kim
7,444,776 B2 11/2008 Adams
D585,516 S 1/2009 Smith
7,472,830 B2 1/2009 Danielson
7,493,722 B2 2/2009 Howe et al.
7,523,583 B2 4/2009 Cheng
7,543,405 B1 6/2009 Ivey
7,562,483 B2 * 7/2009 Hines ..... F41C 27/00 42/71.01
7,591,098 B2 9/2009 Matthews et al.
D603,478 S 11/2009 Hughes
7,614,760 B2 11/2009 Sharrah et al.
D612,970 S 3/2010 Sharrah et al.
7,674,003 B2 3/2010 Sharrah et al.
7,685,759 B2 3/2010 Teetzel
D616,957 S 6/2010 Rievley et al.
7,731,380 B2 6/2010 Wu
7,735,255 B1 6/2010 Kincaid et al.
7,736,013 B2 6/2010 Griffin
7,743,547 B2 6/2010 Houde-Walter
7,784,963 B2 8/2010 Galli et al.
7,805,876 B1 10/2010 Danielson et al.
7,819,547 B1 10/2010 Teetzel et al.
D628,323 S 11/2010 Matthews et al.
7,845,105 B1 * 12/2010 Cahill ..... F41C 27/00 42/117
7,856,749 B2 * 12/2010 Fitzpatrick ..... F41A 35/02 42/96
7,896,518 B2 3/2011 Holmes et al.
7,913,441 B1 3/2011 Reed
D636,049 S 4/2011 Hughes et al.
D636,837 S 4/2011 Hughes et al.
7,941,960 B2 5/2011 Matthews et al.
7,954,971 B1 6/2011 Kincaid et al.
8,028,461 B2 10/2011 NuDyke
8,052,297 B2 11/2011 Gross et al.
8,117,782 B2 2/2012 Gross et al.
8,132,355 B1 3/2012 Kincaid et al.
8,141,286 B1 * 3/2012 Saur ..... F41C 23/08 42/74
8,220,946 B1 7/2012 Teetzel
8,226,267 B2 7/2012 Sharrah et al.
8,256,154 B2 9/2012 Danielson et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
8,276,307 B2 10/2012 Deros
8,287,157 B2 10/2012 Sharrah et al.
D672,005 S 12/2012 Hedeen et al.
8,322,066 B2 12/2012 Westra
D673,709 S 1/2013 Sharrah
D674,525 S 1/2013 Sharrah et al.
D674,861 S 1/2013 Johnston et al.
D674,862 S 1/2013 Johnston et al.
8,353,125 B2 1/2013 Riley
8,371,729 B2 2/2013 Sharrah et al.
8,397,421 B2 3/2013 Ding et al.
8,453,369 B1 6/2013 Kincaid et al.
D687,120 S 7/2013 Hughes et al.
8,499,484 B2 8/2013 Schneider et al.
8,510,979 B1 8/2013 Mortimer
D689,162 S 9/2013 Hilbourne et al.
D691,235 S * 10/2013 Fitzpatrick ..... D22/108
D692,518 S 10/2013 Anderson et al.
D693,898 S 11/2013 Essig et al.
8,578,647 B2 11/2013 Storch et al.
8,584,392 B1 11/2013 Young
D694,847 S 12/2013 Anderson et al.
D694,848 S 12/2013 Anderson et al.
D696,376 S 12/2013 Anderson et al.
8,607,492 B2 12/2013 Hartley et al.
8,650,793 B1 * 2/2014 Mendez ..... F41G 11/003 42/90
8,662,701 B2 3/2014 Sharrah et al.
8,683,731 B2 4/2014 Kowalczyk et al.
8,683,732 B2 4/2014 Joplin
8,683,733 B2 4/2014 Gross et al.
8,701,331 B2 4/2014 Schneider et al.
D704,297 S 5/2014 Cheng
D704,789 S * 5/2014 Fitzpatrick ..... D22/108
8,727,556 B2 5/2014 Swan
8,727,561 B2 5/2014 Sharrah et al.
8,727,565 B2 5/2014 Domagala et al.
D709,158 S 7/2014 Wells
D709,585 S 7/2014 Klecker et al.
D709,981 S 7/2014 Johnston et al.

(56) References Cited

U.S. PATENT DOCUMENTS 8,779,583 B2 7/2014 Pressel et al.
8,779,683 B2 7/2014 Snyder et al.
8,783,908 B2 7/2014 Gross et al.
D712,001 S 8/2014 Wells
8,813,412 B2 8/2014 Rorick
8,820,690 B2 9/2014 Weber
8,850,735 B2 10/2014 Kenney
8,857,097 B2 10/2014 Rorick
8,875,434 B2 * 11/2014 Michal ..... F41C 23/22 42/96
8,904,698 B2 12/2014 Riley et al.
8,915,009 B2 12/2014 Caulk et al.
8,935,874 B2 * 1/2015 Troy ..... F41G 11/003 42/96
8,960,942 B2 2/2015 Galli et al.
8,973,296 B1 3/2015 Kocmich, IV
D729,339 S 5/2015 Chavez et al.
D732,134 S 6/2015 Wells
9,091,508 B2 7/2015 Prieto
9,115,955 B2 * 8/2015 Barnhart ..... F41C 23/16
D738,455 S 9/2015 Homem de Mello Anderson et al.
D738,456 S 9/2015 Hughes
D738,457 S 9/2015 Johnston
D738,987 S 9/2015 Hughes
9,134,094 B2 9/2015 Hilbourne et al.
D740,388 S 10/2015 Klecker et al.
D742,991 S 11/2015 Klecker et al.
9,222,749 B1 * 12/2015 Nakayama ..... F41A 35/02
9,222,756 B1 * 12/2015 Battaglia ..... F41G 11/003
9,239,210 B2 * 1/2016 Mayberry ..... F41G 1/00
D749,689 S 2/2016 Cheng et al.
9,303,955 B2 4/2016 Jeung et al.
9,322,617 B2 4/2016 Hartley et al.
D755,340 S 5/2016 Essig
D755,341 S 5/2016 Hartley
9,328,994 B2 5/2016 Hovsepian
9,377,271 B2 6/2016 Kowalczyk, Jr. et al.
9,395,138 B2 * 7/2016 Troy, Jr. ..... F41C 27/00
D763,398 S 8/2016 Anderson
D763,399 S 8/2016 Anderson
D763,400 S 8/2016 Johnston
9,404,711 B1 8/2016 Hartley et al.
9,435,522 B2 9/2016 Galli et al.
9,453,707 B2 9/2016 Williams et al.
9,488,439 B2 11/2016 Galli et al.
9,506,721 B2 11/2016 Cheng et al.
D777,289 S 1/2017 Cheng et al.
9,551,550 B2 1/2017 Wells
9,568,282 B1 * 2/2017 Schorman ..... G03B 17/561
9,658,031 B1 5/2017 Hedeen et al.
9,677,854 B1 * 6/2017 Tran ..... F41G 11/003
D792,544 S 7/2017 Hartley
9,702,655 B2 * 7/2017 Nakayama ..... F41C 23/16
9,772,161 B1 * 9/2017 Cheng ..... F41G 11/004
9,772,163 B2 9/2017 Sharrah et al.
9,810,411 B2 11/2017 Galli et al.
9,841,258 B1 12/2017 Galli et al.
9,851,176 B2 * 12/2017 Flagler ..... F41C 23/16
9,853,436 B2 12/2017 Simon
9,891,023 B2 2/2018 Compton et al.
9,921,029 B2 * 3/2018 Roberts ..... F41C 33/006
9,964,380 B1 * 5/2018 Oglesby ..... F41C 23/16
9,966,204 B2 5/2018 McCauley et al.
9,989,328 B2 * 6/2018 Ding ..... F41A 35/02
9,991,062 B2 6/2018 Zimmer
10,001,342 B2 6/2018 Sharrah et al.
10,001,344 B1 * 6/2018 Alford ..... F41G 11/003
10,024,632 B1 7/2018 Oglesby
10,041,765 B2 8/2018 McMakin
10,048,040 B1 8/2018 Ratliff
10,107,592 B1 10/2018 Huang et al.
10,288,376 B2 * 5/2019 Gottzmann ..... F41G 11/003
10,344,959 B2 7/2019 Worman et al.
10,352,657 B2 7/2019 Galli et al.
10,365,069 B1 7/2019 Tayon et al.
10,495,407 B1 * 12/2019 Shelton ..... F41C 23/16
10,514,235 B1 12/2019 McCauley et al.
10,557,688 B2 2/2020 Batenhorst et al.
10,612,761 B1 4/2020 Worman et al.
10,619,977 B2 4/2020 Silvennoinen
10,788,292 B2 * 9/2020 Alldredge ..... F41G 11/003
10,942,009 B2 3/2021 Galli
11,105,586 B2 8/2021 Tayon et al.
D931,233 S 9/2021 Pan
11,175,114 B1 11/2021 Lee
11,255,531 B2 2/2022 Shorr, III
11,348,449 B2 5/2022 Zimmer
11,385,027 B2 7/2022 Galli
11,514,775 B2 11/2022 Zimmer
2001/0022044 A1 * 9/2001 Spinner ..... F41G 11/001 42/124
2002/0100202 A1 8/2002 Lin et al.
2002/0100204 A1 8/2002 Kim
2003/0101632 A1 6/2003 Davenport et al.
2003/0106252 A1 * 6/2003 Hines ..... F41A 35/02 42/90
2003/0202345 A1 10/2003 Kim
2004/0000083 A1 * 1/2004 Grant, Jr. ..... F41G 11/003 42/112
2004/0064994 A1 * 4/2004 Luke ..... F41C 23/16 42/90
2004/0148842 A1 8/2004 Aalto et al.
2004/0216352 A1 11/2004 Wooten et al.
2004/0226212 A1 * 11/2004 Shiloni ..... F41C 23/16 42/96
2005/0243542 A1 11/2005 Kim
2005/0246937 A1 11/2005 Kim
2005/0257415 A1 11/2005 Solinsky et al.
2006/0075672 A1 * 4/2006 Romer ..... F41A 35/02 42/10
2006/0196099 A1 9/2006 Matthews et al.
2006/0242882 A1 11/2006 Liu
2007/0006512 A1 * 1/2007 Williams ..... F41G 11/003 42/124
2007/0068058 A1 3/2007 Remo
2007/0068059 A1 3/2007 Kim
2007/0074444 A1 4/2007 Kim
2007/0113462 A1 5/2007 Ho
2007/0147042 A1 6/2007 Sharrah et al.
2007/0193103 A1 8/2007 Cheng
2007/0227056 A1 10/2007 Howe et al.
2007/0253189 A1 11/2007 Kim
2007/0266611 A1 11/2007 Stover
2007/0277422 A1 12/2007 Ding
2008/0022576 A1 1/2008 Epling
2008/0040965 A1 2/2008 Solinsky et al.
2008/0092423 A1 * 4/2008 Keng ..... F41G 11/003 42/111
2008/0094823 A1 4/2008 Kim
2008/0148619 A1 6/2008 Rogers et al.
2008/0205037 A1 8/2008 Griffin
2008/0253110 A1 10/2008 Wu
2009/0013580 A1 1/2009 Houde-Walter
2009/0183416 A1 7/2009 Danielson
2009/0190339 A1 7/2009 Galli et al.
2009/0190341 A1 7/2009 Galli et al.
2009/0241397 A1 10/2009 Fitzpatrick et al.
2009/0293335 A1 12/2009 Danielson
2009/0293855 A1 12/2009 Danielson et al.
2009/0307956 A1 12/2009 Barret
2010/0020535 A1 1/2010 Sharrah et al.
2010/0043271 A1 2/2010 Williams et al.
2010/0097789 A1 4/2010 Sharrah et al.
2010/0176741 A1 7/2010 Sharrah et al.
2010/0229449 A1 9/2010 Matthews et al.
2010/0229450 A1 9/2010 Becker et al.
2010/0236124 A1 9/2010 Troy
2010/0254135 A1 10/2010 Bayat et al.
2010/0263256 A1 10/2010 Spinelli
2011/0047850 A1 3/2011 Rievley et al.
2011/0058362 A1 3/2011 Sun et al.
2011/0061283 A1 3/2011 Cavallo et al.

(56) References Cited

U.S. PATENT DOCUMENTS

2011/0099873 A1* 5/2011 Bentley ..... F41G 11/003 42/71.01
2011/0162251 A1* 7/2011 Houde-Walter ..... F41G 1/35 42/146
2011/0261559 A1 10/2011 Couture et al.
2011/0290968 A1 12/2011 Maughan et al.
2012/0055061 A1 3/2012 Hartley et al.
2012/0055062 A1 3/2012 Mironichev et al.
2012/0085013 A1* 4/2012 Cahill ..... F41C 27/00 42/96
2012/0096755 A1 4/2012 Griffin
2012/0124885 A1 5/2012 Caulk et al.
2012/0144718 A1 6/2012 Danielson et al.
2012/0167436 A1 7/2012 Westra
2012/0168589 A1 7/2012 Riley
2012/0198745 A1 8/2012 Riley et al.
2012/0216440 A1 8/2012 Riley et al.
2012/0227304 A1 9/2012 Engelhardt
2012/0266514 A1 10/2012 Michal et al.
2013/0000176 A1 1/2013 Goertzen
2013/0061506 A1* 3/2013 Atkinson ..... F41G 11/003 42/90
2013/0133238 A1 5/2013 Quetschke et al.
2013/0148367 A1 6/2013 Sharrah et al.
2013/0181021 A1* 7/2013 Yarbrough ..... F41C 33/0236 224/244
2013/0185982 A1 7/2013 Hilbourne et al.
2013/0318852 A1* 12/2013 Teetzel ..... F41C 27/00 42/90
2013/0326925 A1* 12/2013 Power ..... F41A 35/02 42/71.01
2014/0018508 A1 1/2014 Masubuchi et al.
2014/0092588 A1 4/2014 Toman et al.
2014/0109457 A1* 4/2014 Speroni ..... F41G 1/35 42/114
2014/0196349 A1 7/2014 Rogers et al.
2014/0252187 A1 9/2014 Petrovic
2014/0305021 A1 10/2014 Prieto
2014/0360077 A1* 12/2014 Miller ..... F41C 27/00 42/84
2014/0373329 A1* 12/2014 Volfson ..... F16M 13/02 248/221.11
2015/0124436 A1 5/2015 Galli et al.
2015/0143734 A1 5/2015 Ley
2015/0159847 A1 6/2015 Galli et al.
2015/0241169 A1 8/2015 Cheng et al.
2015/0241174 A1 8/2015 Silvennoinen
2015/0267999 A1 9/2015 Hovsepian
2015/0276347 A1 10/2015 Sharrah et al.
2015/0276352 A1 10/2015 Chang et al.
2015/0300386 A1 10/2015 Fong et al.
2016/0003460 A1 1/2016 Li et al.
2016/0025120 A1 1/2016 Swan et al.
2016/0091272 A1* 3/2016 Hines ..... F41C 23/16 42/90
2016/0091278 A1* 3/2016 Jen ..... F41C 23/16 42/90
2016/0146572 A1 5/2016 Ley
2016/0161220 A1 6/2016 Moore et al.
2016/0169610 A1* 6/2016 Hines ..... F41A 35/00 42/90
2016/0195366 A1 7/2016 Kowalczyk et al.
2016/0209168 A1 7/2016 Sharrah et al.
2016/0209174 A1 7/2016 Hartley et al.
2016/0209175 A1* 7/2016 Sharron ..... F41G 11/003
2016/0211095 A1* 7/2016 Zimmer ..... H01H 9/0235
2016/0349013 A1 12/2016 Ley
2016/0377385 A1 12/2016 Culp
2017/0138701 A1 5/2017 Kowalczyk, Jr. et al.
2017/0167817 A1 6/2017 Hayes
2017/0191801 A1* 7/2017 Tresserras Torre ... F41G 11/002
2017/0219314 A1 8/2017 McMakin
2017/0234646 A1 8/2017 Flagler
2017/0234653 A1* 8/2017 Maughn ..... F41G 11/003 42/124
2017/0248389 A1 8/2017 DiCarlo et al.
2017/0299337 A1* 10/2017 Ding ..... F41G 11/004
2018/0023926 A1 1/2018 Jayaprakash
2018/0031352 A1 2/2018 Zeisler et al.
2018/0038580 A1 2/2018 Galli et al.
2018/0053607 A1* 2/2018 McCauley ..... F41G 11/003
2018/0094904 A1* 4/2018 Greenwood ..... F41G 11/003
2018/0112952 A1* 4/2018 Kincel ..... F41C 23/16
2018/0142991 A1* 5/2018 Rogers ..... F41G 11/004
2018/0164078 A1* 6/2018 Hancosky ..... F41G 11/004
2018/0216911 A1* 8/2018 Jen ..... F41G 11/003
2018/0283670 A1 10/2018 Galli et al.
2018/0364009 A1* 12/2018 Hancosky ..... F41G 11/003
2019/0154243 A1 5/2019 Worman et al.
2019/0242677 A1* 8/2019 Ding ..... F41G 11/003
2019/0316882 A1 10/2019 Galli et al.
2019/0323541 A1* 10/2019 Windfeldt ..... F16B 21/02
2020/0232601 A1* 7/2020 Chavez ..... F16M 11/041
2021/0054964 A1* 2/2021 Chen ..... F41G 11/001
2021/0055078 A1* 2/2021 Roberson ..... F41G 1/16
2021/0088310 A1* 3/2021 Planck ..... F41G 11/003
2021/0108891 A1* 4/2021 Ma ..... F41G 1/387
2021/0254930 A1* 8/2021 Pischke ..... F41C 27/00
2021/0302123 A1* 9/2021 Mayberry ..... F41G 1/00
2021/0333068 A1 10/2021 Lindsay et al.
2021/0356231 A1 11/2021 Tayon et al.
2022/0136800 A1 5/2022 Lee et al.
2022/0412696 A1 12/2022 Teetzel et al.

* cited by examiner

LOW PROFILE RAIL MOUNT FOR FIREARM

CROSS-REFERENCE TO RELATED APPLICATIONS

This application is a divisional of and claims priority to U.S. application Ser. No. 17/032,493, filed Sep. 25, 2020, which claims the benefit of U.S. Provisional Application No. 62/905,902, filed Sep. 25, 2019, the entireties of which are hereby incorporated by reference.

FIELD

The present disclosure generally relates to mounting hardware for attaching an accessory to a firearm rail, such as a Picatinny® or M-Lok® rail, and in particular, a low profile mounting system that reduces bulk when mounting an accessory to a firearm.

BACKGROUND

Rail systems on firearms are mounting brackets (usually made of strips of metal or polymer) on the gun's receiver, handguard, or fore-end stock to allow attachment of accessories such as optical sights, tactical lights, laser sight and the like. Rail systems usually are based on the handguard of a weapon and/or the upper receiver. Common types of rail systems for firearms are the dovetail rail, the Weaver rail, the Picatinny® rail (also known as the MIL-STD-1913 or STANAG 2324 rail), and the Magpul M-Lok®. One of the problems with mounting to rail systems is that the mounting hardware creates added bulk.

SUMMARY

In one aspect, a low profile rail mounting system comprises an adaptor comprising flexible material permitting the adaptor to be snapped into position to mount the adaptor on a firearm rail. The adaptor includes an upper adaptor section configured to seat on the firearm rail. The adaptor includes a first wing section and a second wing section each extending distally from opposite sides of the upper adaptor section and extending over the firearm rail when mounted. The adaptor includes a first foot section and a second foot section on a distal end of the respective first wing section and second wing section. The first foot section and first wing section form a first groove, and the second foot section and second wing section form a second groove to secure the adaptor to the firearm rail when mounted.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
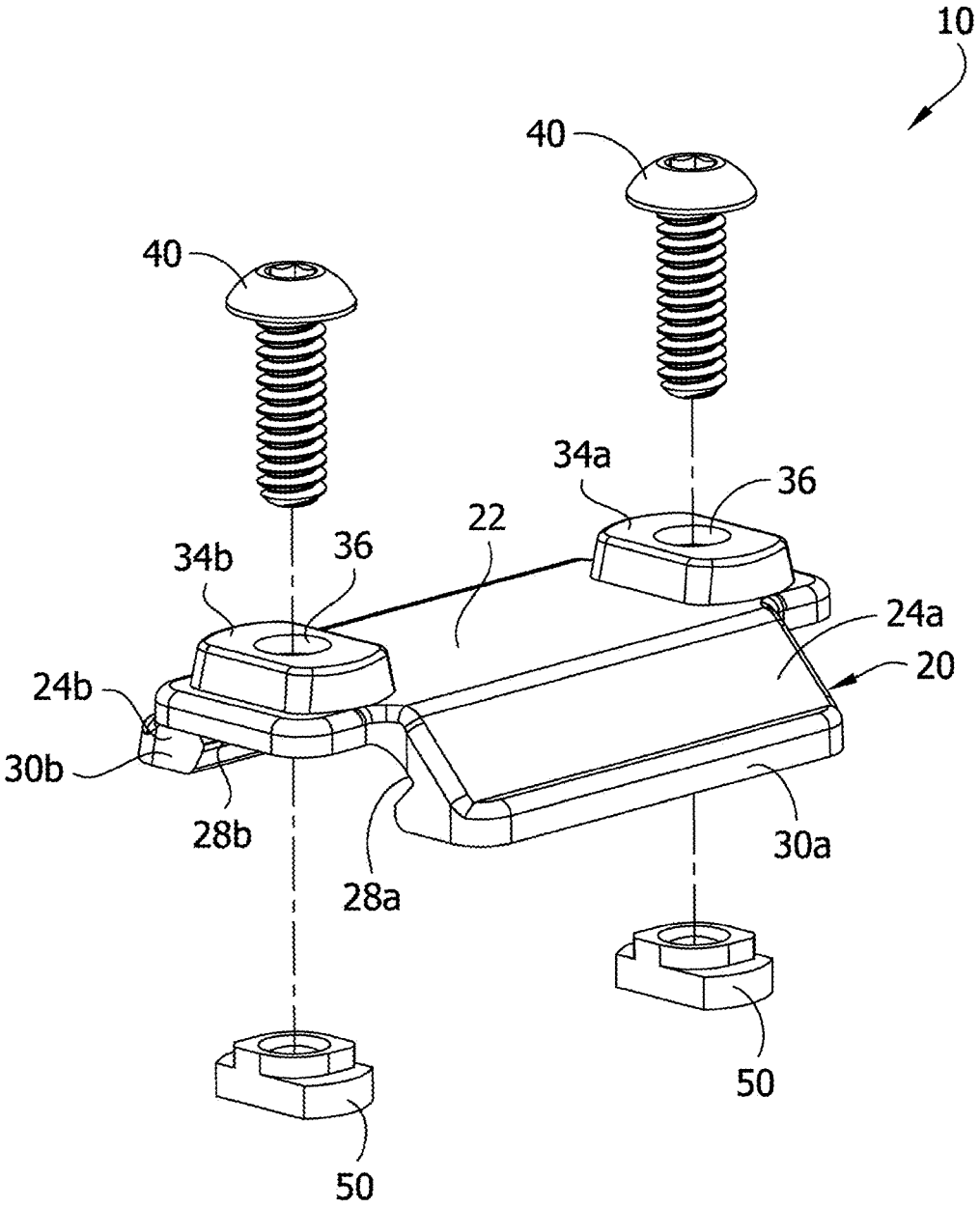
FIG. 1 is a top perspective of a low profile rail mounting system.

Disclosed herein is a low profile rail mounting system for mounting to a firearm rail, such as a Picatinny® or M-Lok® rail. The disclosed low profile rail mounting system allows for easy mounting of firearm accessories, such as scopes, laser sites, and the like, to the rail and hence the firearm to which the rail mounting system is attached. The low profile rail mounting system includes an adaptor (e.g., adaptor plate) that comprises a flexible material permitting the adaptor to be snapped into position. For example, the flexible material may include plastic, fiber reinforced plastic, fiber reinforced polymer, and/or polymer material. The adaptor may be composed entirely of the flexible material. Alternatively, the adaptor may include non-flexible material in combination with the flexible material (e.g., providing relatively rigid portions and relatively flexible portions). The adaptor incudes an upper section configured to seat on a firearm rail, making contact with the upper or top surface(s) of the rail. For example, the adaptor can straddle the rail transverse to the long axis (longitudinal axis) of the rail or firearm. The adaptor extends longitudinally along the top of the rail, for example over one or more cross slots of the firearm rail. The adaptor plate includes a first wing section and a second wing section each extending distally from opposite sides of the upper section and extending over and at least partially encircling the sides of the firearm rail when mounted. Foot sections are connected to respective wing sections. The first foot section and first wing section form a first groove (e.g., v-groove) on what would be considered the interior of the adaptor. The second wing section forms a second groove (e.g., v-groove) opposite the first groove on the interior of the adaptor. The first groove and the second groove work together on opposite sides of the rail system to secure the adaptor to the firearm rail when mounted thereon, for example, by capturing the respective sides of the rail. The sides of the rail may be triangular portions of the rail that protrude laterally. The adaptor plate includes one or more risers on the upper section, for example, to place an accessory at a proper height relative to the rail, barrel, and/or receiver of the firearm. The adaptor includes one or more alignment bosses on a bottom surface of the upper section (considered the inside of the adaptor plate) that are configured to align with and be received in cross slots on the firearm rail when mounted. The alignment bosses work to align the adaptor and hence the accessory longitudinally with respect to the rail and/or firearm. The adaptor first foot section and second foot section each include a tapered section opposite the grooves. The tapered sections are configured to provide an interference taper fit between the adapter and firearm accessory such that when the adaptor and the firearm accessory are connected, the grooves are biased inward to provide lateral clamping force between the firearm accessory and the firearm rail. Desirably, the adaptor protrudes less than ¾ inch, more desirably less than ⅝ inch, and more desirably less than ½ inch, from a surface of the rail on which the upper section is seated when installed.

The low profile rail mounting system can include one or more fasteners, such as screws, bolts and the like, that can secure a firearm accessory to the adaptor, for example when mounted to the rail system. The one or more fasteners can further secure the adaptor to the firearm rail when mounted.

In some examples, the one or more fasteners are of sufficient length to extend through both the accessory and the adaptor plate to secure both the accessory and the adaptor plate to the firearm rail. The low profile rail mounting system further includes one or more nuts, such as t-nuts, to secure the one or more fasteners that are secured to the underside of the adaptor.

The low profile rail mounting system can include a firearm accessory, such as laser site, and/or a scope. The low profile rail mounting system can include a rail system, such as a Picatinny® rail system or a M-Lok® rail system.

Referring now to FIGS. 1-6, a low profile rail mounting system 10 includes an adaptor 20, fasteners 40, and T-nuts 50. The adaptor 20 (e.g., "adaptor plate") includes an upper section 22, a first wing section 24*a*, and a second wing section 24*b* that extend from the upper section 22, for example to at least partially envelop a portion of the rail. The adaptor 20 can further include risers 34*a* and 34*b* which include openings 36 to accommodate fasteners 40. The adaptor 20 further includes a first foot section 30*a* and a second foot section 30*b* on the distal ends of the respective first wing section 24*a* and second wing section 24*b*. Together, the first foot section 30*a* and first wing section 24*a* form a first groove 28*a* (e.g., "v-groove"), and the second foot section and 30*b* second wing section 24*b* form a second groove 28*b* (e.g., "v-groove") to secure the adaptor 20 to a firearm rail. For example, the adaptor may clamp or pinch the rail between the two grooves 28*a* and 28*b*.

Figure 2:
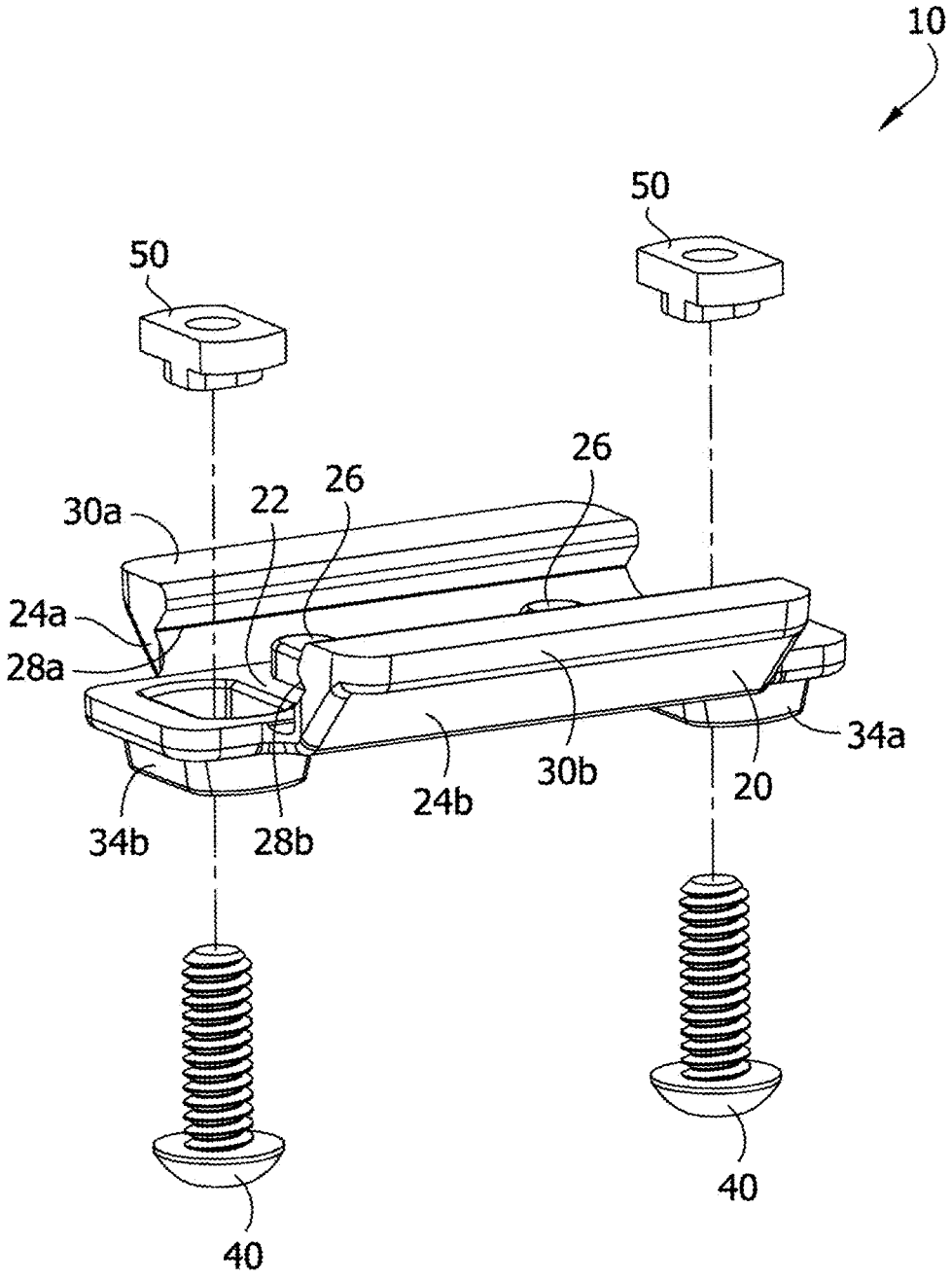
FIG. 2 is a bottom perspective of the low profile rail mounting system shown in FIG. 1.

With reference to FIG. 2, the adaptor 20 can further include alignment bosses 26 on a lower surface of the upper section 22. The alignment bosses 26 are spaced and configured to align with and be received in cross slots of the firearm rail when mounted.

Figure 3:
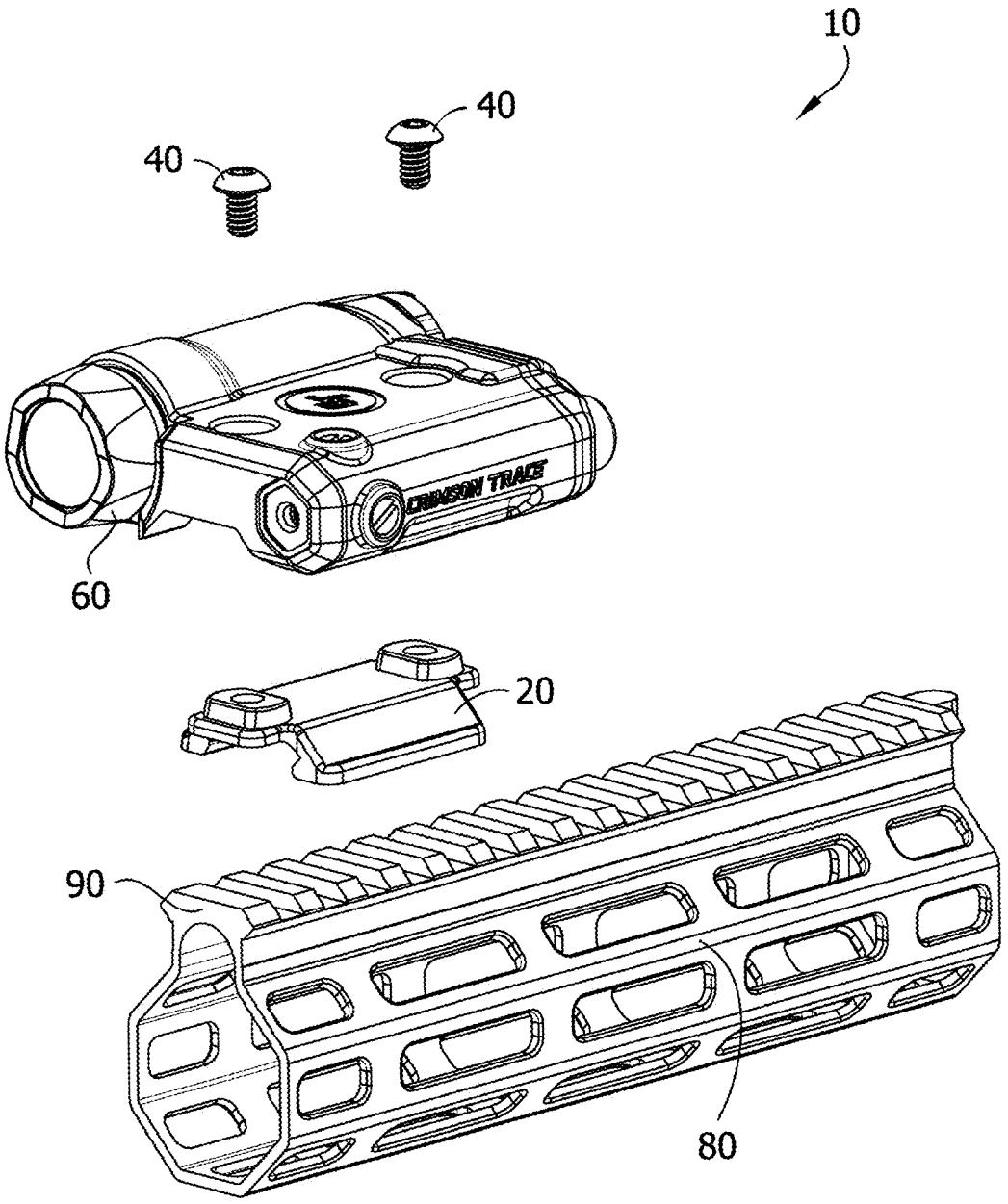
FIG. 3 is a top front perspective of a low profile rail mounting system, an accessory, and a Picatinny® rail.

Turning to FIG. 3, the relative positions of the adaptor 20, the fasteners 40, an accessory 60, in this case a laser sight, and a Picatinny® rail 90 situated on a hand guard 80 are depicted prior to assembly. As shown, the adaptor 20 snaps over the a Picatinny® rail 90, where it forms a snap fit and can be secured, along with the accessory 60, by the fasteners 40.

Figure 4:
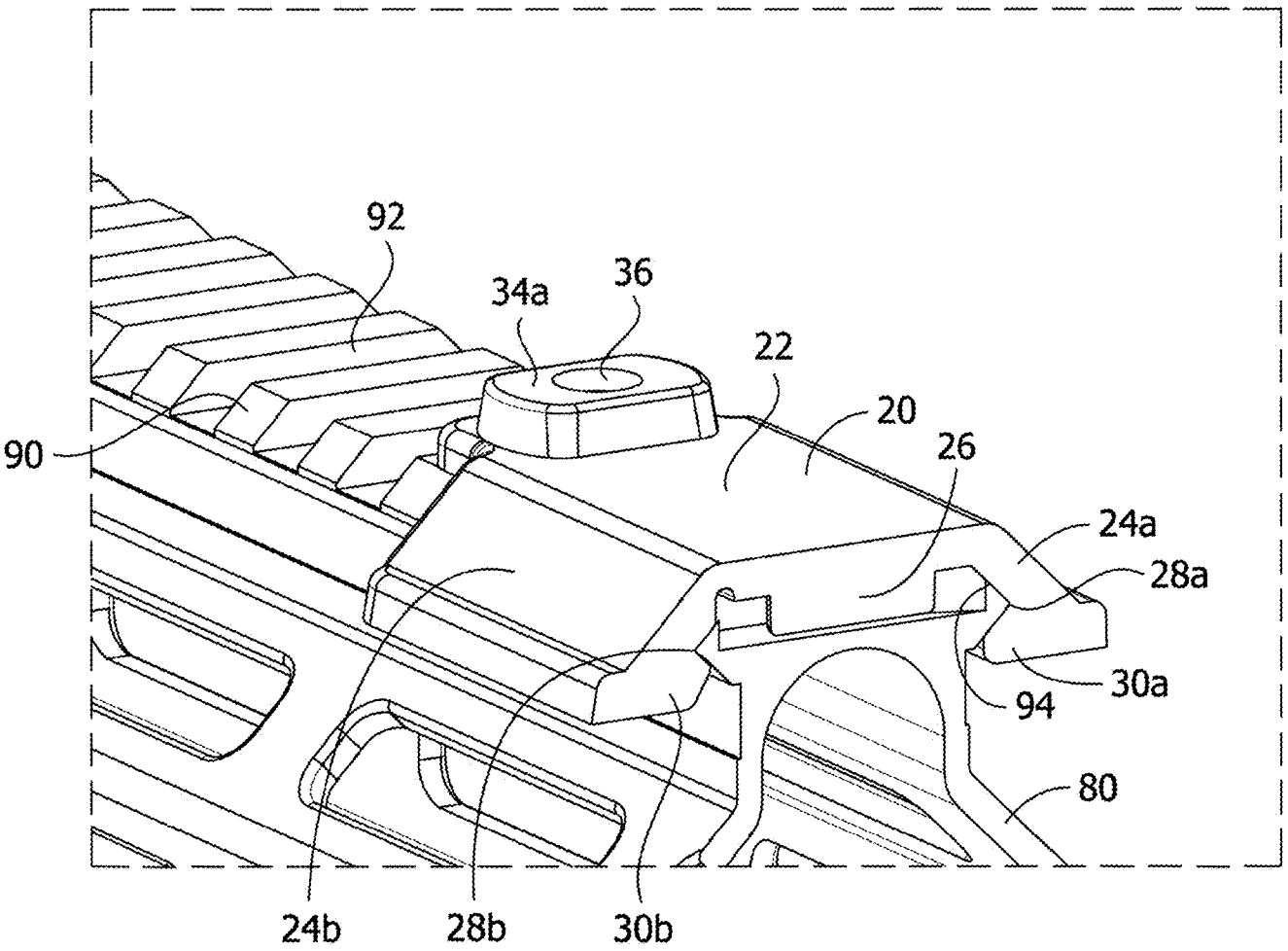
FIG. 4 is a cross-sectional top perspective of a low profile rail mounting system mounted to a Picatinny® rail.

Turing to FIG. 4, a cross-sectional top perspective of the adaptor 20 mounted to a Picatinny® rail 90 is shown to illustrate how the adaptor 20 couples to the Picatinny® rail 90. As seen in FIG. 4, the first groove 28*a* and the second groove 28*b* dove tail to the protruding sides 94*a* and 94*b* of the Picatinny® rail 90. As the adaptor 20 snaps over the a Picatinny® rail 90, the first groove 28*a* and the second groove 28*b* act together to secure the adaptor 20 in place, for example as a snap- or pinch-fit, on the Picatinny® rail 90. Also, as seen in FIG. 4, the alignment bosses 26 on the bottom surface of the upper section 22 protrude into the cross slots 92 of the Picatinny® rail 90. This nesting of the alignment bosses 26 within the cross slots 92 limits the adaptor 20 from moving axially along the Picatinny® rail 90.

Figure 5:
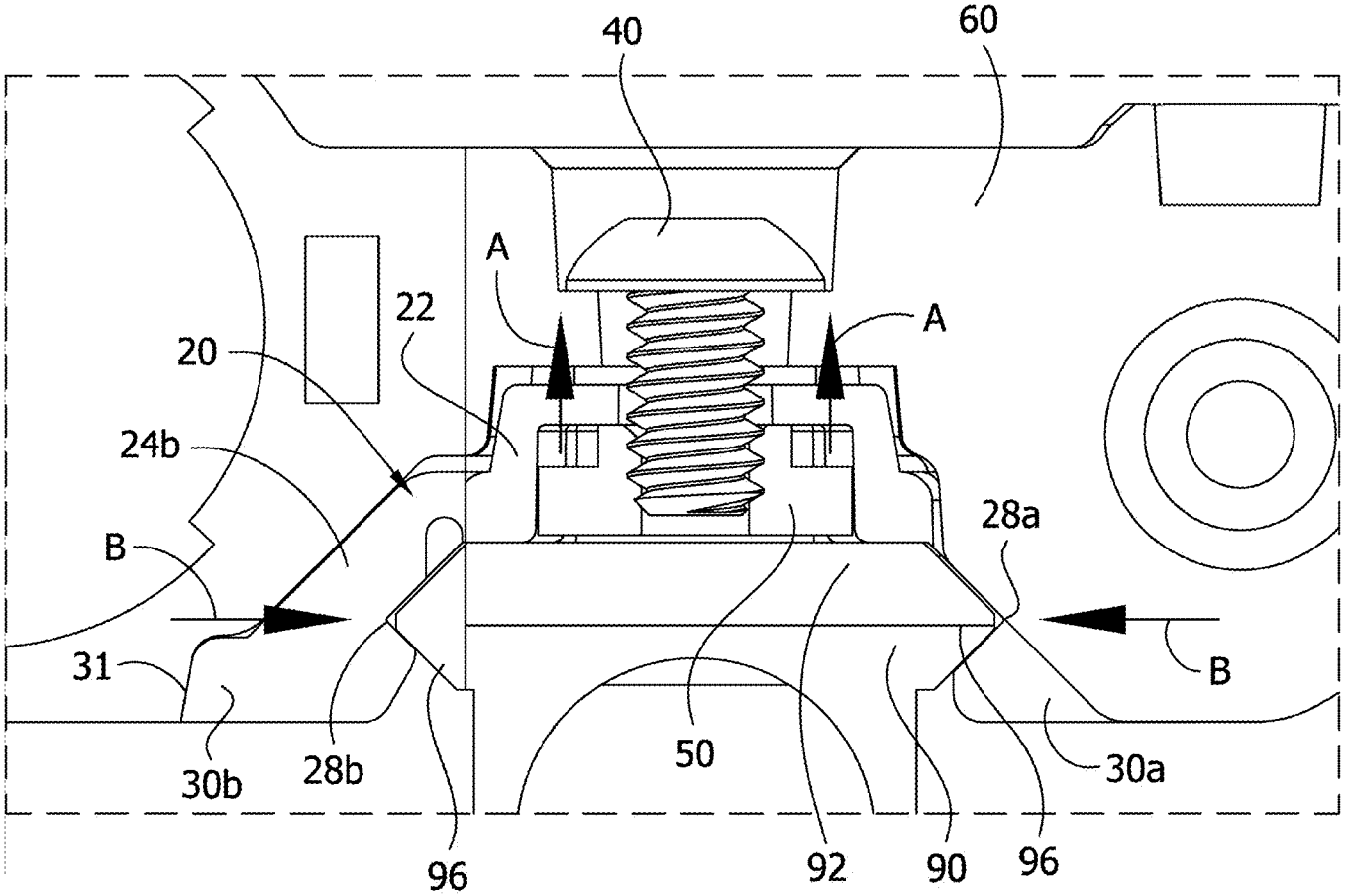
FIG. 5 is a cross-sectional view of a low profile rail mounting system and accessory mounted to a Picatinny® rail.

Turning to FIG. 5, a cross-sectional view of the adaptor 20 and an accessory 60 is shown mounted to a Picatinny® rail 90 system with fasteners 40 and t-nuts 50. This view shows how the components of the low profile rail mount system work together to secure the adaptor 20 and the accessory 60 to the Picatinny® rail 90. As the t-nut 50 is drawn up (see arrows A) by tightening of the fasteners 40, the accessory 60 is drawn down, relative to the adaptor 20. As the accessory 60 is drawn down, it pushes on taper 31 of the first foot section 30*a* and the second foot section 30*b* causing the first wing section 24*a* and the second wing section 24*b* to clamp to the Picatinny® rail 90 with the first groove 28*a* and the second groove 28*b*. This interference taper fit between the adapter 20 and the accessory 60 is such that when the fasteners 40 are torqued in place, the grooves 28*a* and 28*b* on the adapter 20 are biased inward (see arrows B) providing lateral clamping force between the adaptor 20 (and thus the accessory 60) and the Picatinny® rail 90.

Figure 6A:
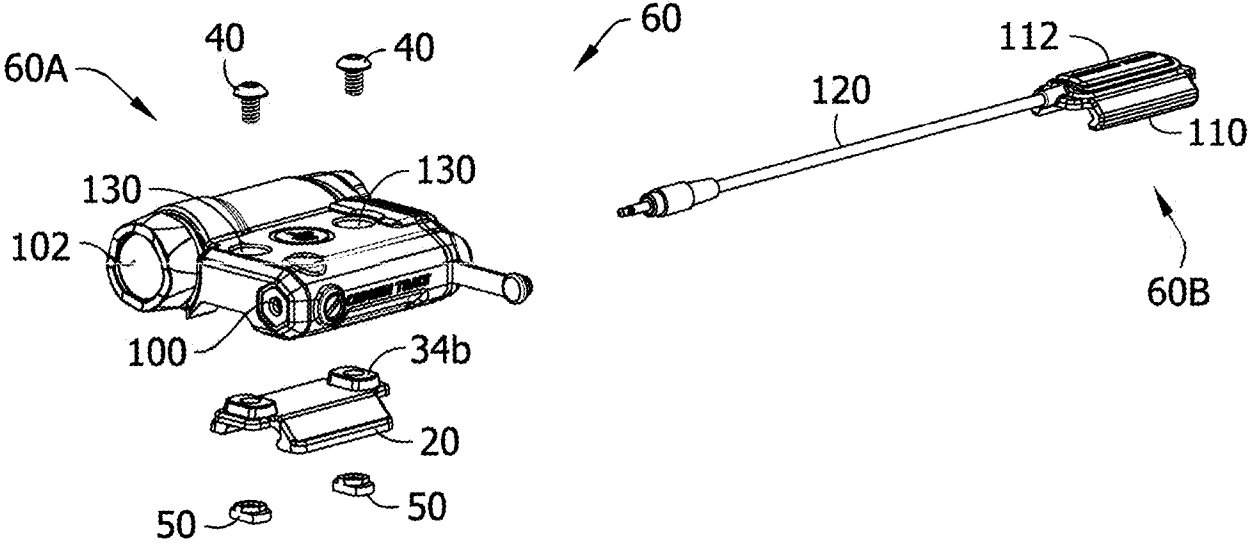
FIGS. 6A-6C show a laser sight accessory and a low profile rail mounting system.
Figure 6B:
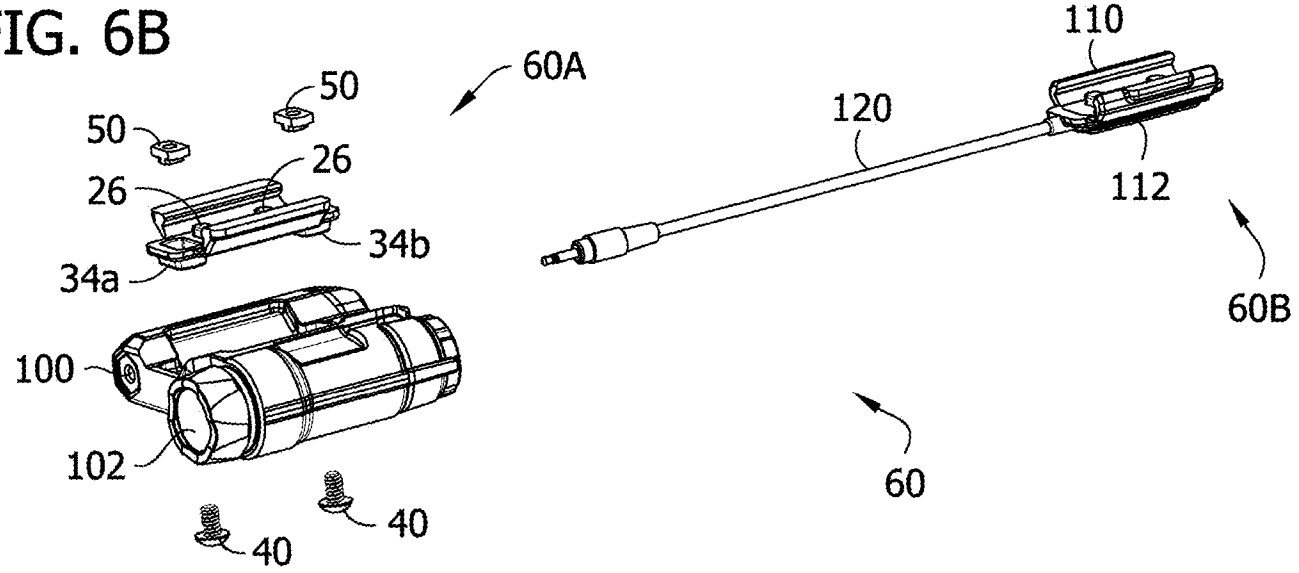
Figure 6C:
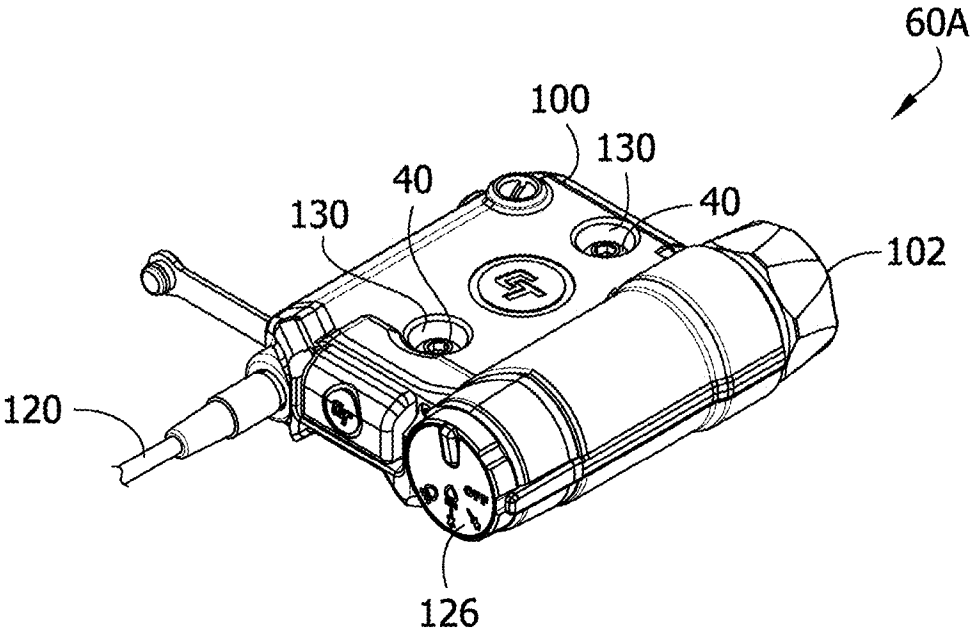
Figure 6C:
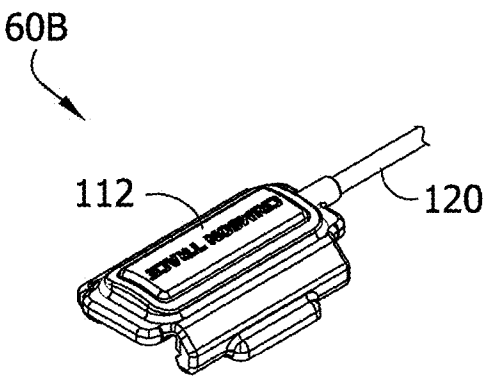

FIGS. 6A-6C illustrate an accessory system 60 and the low profile rail mounting system 10. In the illustrated embodiment, the accessory system 60 includes an accessory 60A and an associated remote switch 60B. For example, the accessory 60A can include a laser 100 (broadly, "sight") and/or a light 102. In the illustrated embodiment, the accessory 60A includes a laser 100 and a light 102 with a shared housing that is mountable to a firearm rail using the adaptor 20. The remote switch 60B includes a mount 110 having a similar construction as the adaptor 20 (e.g., wings, feet, flexible material) enabling the remote switch to be mounted to the firearm rail system (e.g., on same or different rail as the accessory 60A) in a similar snap-on manner. The remote switch 60B includes an actuator 112 (e.g., push-button switch and/or momentary switch) for actuating the accessory 60A (e.g., on, off, different modes, etc.). The remote switch 60B can be tethered to the accessory by connecting a tether 120 to the accessory 60A (e.g., plugging a male connector into a port on the accessory). In some circumstances, the remote switch 60B may not be used. Whether the remote switch is used or not, the accessory 60A can be actuated using one or more actuators (e.g., rotary dial 126) on the accessory. It will be appreciated that the light 102 and laser 100 are provided in a side-by-side arrangement to provide a low profile fit on the firearm. The housing of the accessory 60A straddles the adaptor 20, with the light 102 and laser 100 on opposite sides of the adaptor. The housing of the accessory 60A includes a portion between the light 102 and laser 100 to which the adaptor is connected via the fasteners 40. In particular, the intermediate portion of the housing includes openings 130 through which the fasteners 40 extend. The risers 34*a*, 34*b* of the adaptor 20 are received in a recess on the bottom of the accessory 60A. The arrangement is such that the light 102 and laser 100 are positioned to opposite sides of the rail and/or straddle the rail to which the adaptor 20 is mounted. To install the accessory 60A on the rail, the accessory and adaptor 20 can be loosely connected by the fasteners 40. Then the adaptor 20 is snapped onto the rail, and the fasteners 40 are tightened to draw the nuts 50 toward the adaptor. The tightened fasteners 40, the clamping of the adaptor 20 on the rail, and the bosses 34*a*, 34*b* in the rail, serve to secure the adaptor and thus the accessory in position on the rail.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A low profile mounting system for mounting on a firearm component, the system comprising:

a nut; and an adaptor mountable on the firearm component, the adaptor comprising:

an upper adaptor section;

a first foot section supported by the upper adaptor section;

a second foot section supported by the upper adaptor section, the first foot section and the second foot section being configured to snap the adaptor on onto the firearm component with the first and second foot sections in mounting engagement with the firearm component; and an accessory mount for connecting an accessory to the adaptor via the nut, the accessory mount including a nut holder configured to limit rotation of the nut.

2. The system of claim 1, wherein the adaptor comprises flexible material configured to permit the first and second foot sections to snap the adaptor onto the firearm component.

3. The system of claim 2, wherein at least one of the first or second foot sections has an at rest position and the flexible material is configured to permit said at least one foot section to deflect away from the at rest position and to resiliently return toward the at rest position to provide a snap connection to the firearm component.

4. The system of claim 1, wherein the adaptor is formed from a single piece of material.

5. The system of claim 1, wherein the upper adaptor section, the first foot section, and the second foot section are integrally formed as a unitary piece of material.

6. The system of claim 1, further comprising at least one alignment boss configured to be received in a slot of the firearm component, the at least one alignment boss extending downwardly from the upper adaptor section and being fixed in position with respect to the upper adaptor section.

7. The system of claim 1, further comprising at least one alignment boss configured to be received in a slot of the firearm component, the at least one alignment boss extending downwardly from the upper adaptor section, the alignment boss and upper adaptor section being integrally formed as a unitary piece of material.

8. The system of claim 1, wherein the nut comprises a t-nut.

9. The system of claim 1, wherein the accessory mount is supported by the upper adaptor section.

10. The system of claim 9, wherein the accessory mount extends upwardly from the upper adaptor section.

11. The system of claim 1, wherein the nut holder includes a recess configured to receive the nut.

12. The system of claim 11, wherein the accessory mount includes an opening extending from the recess.

13. The system of claim 12, further comprising a fastener sized and shaped to be receive through the opening in the accessory mount and coupled to the nut to connect the accessory to the adaptor.

14. The system of claim 1, wherein the accessory mount includes an opening, and wherein the system further comprises a fastener sized and shaped to be receive through the opening in the accessory mount and coupled to the nut to connect the accessory to the adaptor.

15. The system of claim 1, wherein the adaptor includes first and second grooves configured to receive the firearm component to mount the adaptor on the firearm component.

16. The system of claim 15, wherein the first food section boarders the first groove and the second foot section boarders the second groove.

17. The system of claim 1, wherein the adaptor is configured to provide an interference fit between the adaptor and the accessory such that when the adaptor is mounted on the firearm component, the first and second foot sections are biased inward to provide lateral clamping force on the firearm component.

18. The system of claim 1, wherein the first foot section includes a taper shaped and arranged on the adaptor to be engaged by the accessory to drive the first foot section toward the second food section to further secure the adaptor to the firearm component when the adaptor and accessory are mounted on the firearm component.

19. The system of claim 1, wherein the first and second foot sections are arranged on the adaptor to be engaged by the accessory to bias the first and second foot sections toward one another to further secure the adaptor to the firearm component when the adaptor and accessory are mounted on the firearm component.

20. The system of claim 1, wherein the nut is a first nut, the accessory mount is a first accessory mount, and the nut holder is a first nut holder, wherein the system further comprises a second nut, wherein the adaptor comprises a second accessory mount for connecting the accessory to the adaptor via the second nut, the second accessory mount including a second nut holder configured to limit rotation of the second nut.

* * * * *